US006540047B2

(12) United States Patent
Yasui et al.

(10) Patent No.: US 6,540,047 B2
(45) Date of Patent: Apr. 1, 2003

(54) LUBRICATION DEVICE OF FOUR-STROKE-CYCLE ENGINE

(75) Inventors: Nobuhiro Yasui, Hamamatsu (JP); Osamu Kasuya, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 73 days.

(21) Appl. No.: 09/785,490

(22) Filed: Feb. 20, 2001

(65) Prior Publication Data

US 2001/0020560 A1 Sep. 13, 2001

(30) Foreign Application Priority Data

Feb. 17, 2000 (JP) ..... 2000-039906

(51) Int. Cl.[7] ..... F01M 5/00

(52) U.S. Cl. ..... 184/104.2; 184/6.22; 184/106; 123/196 AB

(58) Field of Search ..... 184/6.21, 6.22, 184/6.28, 6.5, 106, 104.2, 104.3; 123/196 R, 196 A, 196 AB; 74/606 R, 606 A

(56) References Cited

U.S. PATENT DOCUMENTS

| | | | | |
|---|---|---|---|---|
| 3,223,197 A | * | 12/1965 | Conover et al. | 184/104.3 |
| 5,887,561 A | * | 3/1999 | Spurgin | 123/196 AB |
| 6,058,898 A | * | 5/2000 | Freese | 123/195 C |
| 2001/0020560 A1 | * | 9/2001 | Yasui et al. | 256/27 |

* cited by examiner

*Primary Examiner*—David Fenstermacher
(74) *Attorney, Agent, or Firm*—Oblon, Spivak, McClelland, Maier & Neustadt, P.C.

(57) ABSTRACT

In a lubrication device of four-stroke-cycle engine, a front surface portion of a lower engine case is positioned vertically, while mounting-bases for an oil filter are formed onto the front surface portion, and an oil passage extending to an oil entrance of an oil filter from an oil pump is positioned in parallel with the matching surfaces of the engine case, as well as an additional oil passage positioned for connecting an oil exit of the oil filter and a main gallery.

6 Claims, 6 Drawing Sheets

LUBRICATION DEVICE OF FOUR-STROKE-CYCLE ENGINE

BACKGROUND OF THE INVENTION

1. Field of the Invention

The present invention relates to a lubrication device of four-stroke-cycle engine.

2. Discussion of the Background

An engine equipped to the vehicle, such as a motorcycle, has many sliding and rotating parts inside. Therefore, lubricating oil is supplied to every part inside the engine by using a lubrication device in order to decrease frictional resistance of every part by the function of lubricating all so that the engine functions sufficiently. Further, there is a kind of engine wherein every part of the engine is cooled actively by lubricating oil.

The typical example of the lubricating device for a four-stroke-cycle engine with a wet sump type lubricating system is as follows:

An oil pan is disposed at the lower part of an engine case of an engine. An oil pump pumps up the lubricating oil stored in the oil pan. The oil is then filtered with an oil filter, and cooled by an oil cooler in some cases. After the filtration (and cooling), the oil is sent to the parts inside the engine, where the lubrication is required, through a main gallery that is formed inside the engine case.

Further, in most cases, the oil passage that reaches to the main gallery from the oil pump is formed normal to the mounting surface of the oil filter because of a mold construction of the engine case.

However, because of the construction of the engine such as arrangements of the oil pump, the oil filter and the oil cooler, many connecting passages may be needed in order to form the oil passage network. As a result, the time increase in processing the engine case and the requirements of many blind plugs for the connecting passages would become the factors for the cost increasing.

Furthermore, similar to the oil passage, the connecting passages are arranged normal to each other because of the mold construction of the engine case, which make the oil passages longer. Moreover, since the connecting passages are arranged normal to each other, there might be a chance that the oil pressure in the passages would drop. This unnecessary drop of the oil pressure would lead undesirable factors, such as an unnecessary enlargement of the oil pump, restrictions of layouts, weight increases, and an increase of the mechanical loss.

SUMMARY OF THE INVENTION

An object of the present invention is to substantially eliminate defects or drawbacks encountered in the prior art described above and to provide a lubrication device of four-stroke-cycle engine that simplifies and reduces the length of the oil passage that reach to the main gallery from the oil pump.

This and other objects can be achieved according to the present invention by providing a lubrication device of four-stroke-cycle engine comprising an engine case dividable at least into two pieces in vertical direction in a normal operating situation, the divided engine case having matching surfaces being obliquely upward to the rear, a lower part of the engine case having substantially horizontal bottom surface portion, an oil pan attached to the bottom surface portion, oil passages, which guide lubricating oil in the oil pan to a main gallery by an oil pump, formed in the lower part of the engine case, and an oil filter disposed on the oil passages, the lubrication device comprising:

a front surface portion of the lower part of the engine case formed normal to matching surfaces of the lower part of the engine case and the oil pan, an oil-filter-mounting-base formed onto the front surface portion of the lower part of the engine case, an oil passage, which extends to an oil entrance of the oil filter from the oil pump, formed in parallel with the matching surfaces of the divided engine case, and an additional oil passage, which connects an oil exit of the oil filter and the main gallery.

In preferred embodiments, the lubrication device further comprising:

an oil cooler disposed on the oil passages, and an oil-cooler-mounting-base formed with the oil-filter-mounting-base onto the front surface portion of the lower part of the engine case side by side in the engine width direction, wherein the oil passage comprises a first oil passage, and the additional oil passage is composed of a second oil passage and a third oil passage, the second oil passage being connected to an oil exit of the oil filter and an oil entrance of the oil cooler, is formed normal to the front surface portion of the lower part of the engine case, and in parallel with the matching surfaces of the lower part of the engine case and the oil pan, and the third oil passage, being extended to the main gallery from an oil exit of the oil cooler, is formed in parallel with the matching surfaces of the divided engine case.

Further, an oil entrance port and an oil exit port for the oil filter are disposed in the oil-filter-mounting-base coaxially, and an oil entrance port and an oil exit port for the oil cooler are disposed in the oil-cooler-mounting-base coaxially, the oil exit port for the oil filter and the oil entrance port for the oil cooler, being connected to the second oil passage which is formed normal to the front surface portion of the lower part of the engine case, are disposed in centers of the mounting-bases, the oil entrance port for the oil filter, being connected to the first oil passage, is disposed in the circumference side of the oil exit port for the oil filter, and the oil exit port for the oil cooler, being connected to the third oil passage, is disposed in the circumference side of the oil entrance port for the oil filter.

Furthermore, the oil entrance port for the oil filter and the oil exit port for the oil cooler, being connected to the first and third oil passages, are disposed separately in vertical direction.

Further, the second oil passage is composed of two sub-passages which connect the oil exit port for the oil filter and the oil entrance port for the oil cooler to a main passage, while the main passage is disposed behind the mounting-bases and below the first oil passage.

Moreover, the oil-filter-mounting-base and the oil pump are disposed on the same side of the engine.

According to the lubrication device of the present invention of the characters described above, arranging the passages without interfering with each other, and in a shortest distance, becomes possible. Moreover, the oil passages become simplified, which leads to a reduced cost of processing the engine case.

Further, the mutual interference of each passage may be avoided, so that the unnecessary drop of the oil pressure would be prevented. As a result, an unnecessary enlargement of the oil pump, restrictions of layouts, weight increases, and an increase of the mechanical loss are prevented.

The further nature and features of the present invention will be made clearer hereunder through descriptions with reference to the accompanying drawings.

DESCRIPTION OF THE PREFERRED EMBODIMENT

One embodiment of the present invention will be described hereunder with reference to the accompanying drawings.

Figure 1:
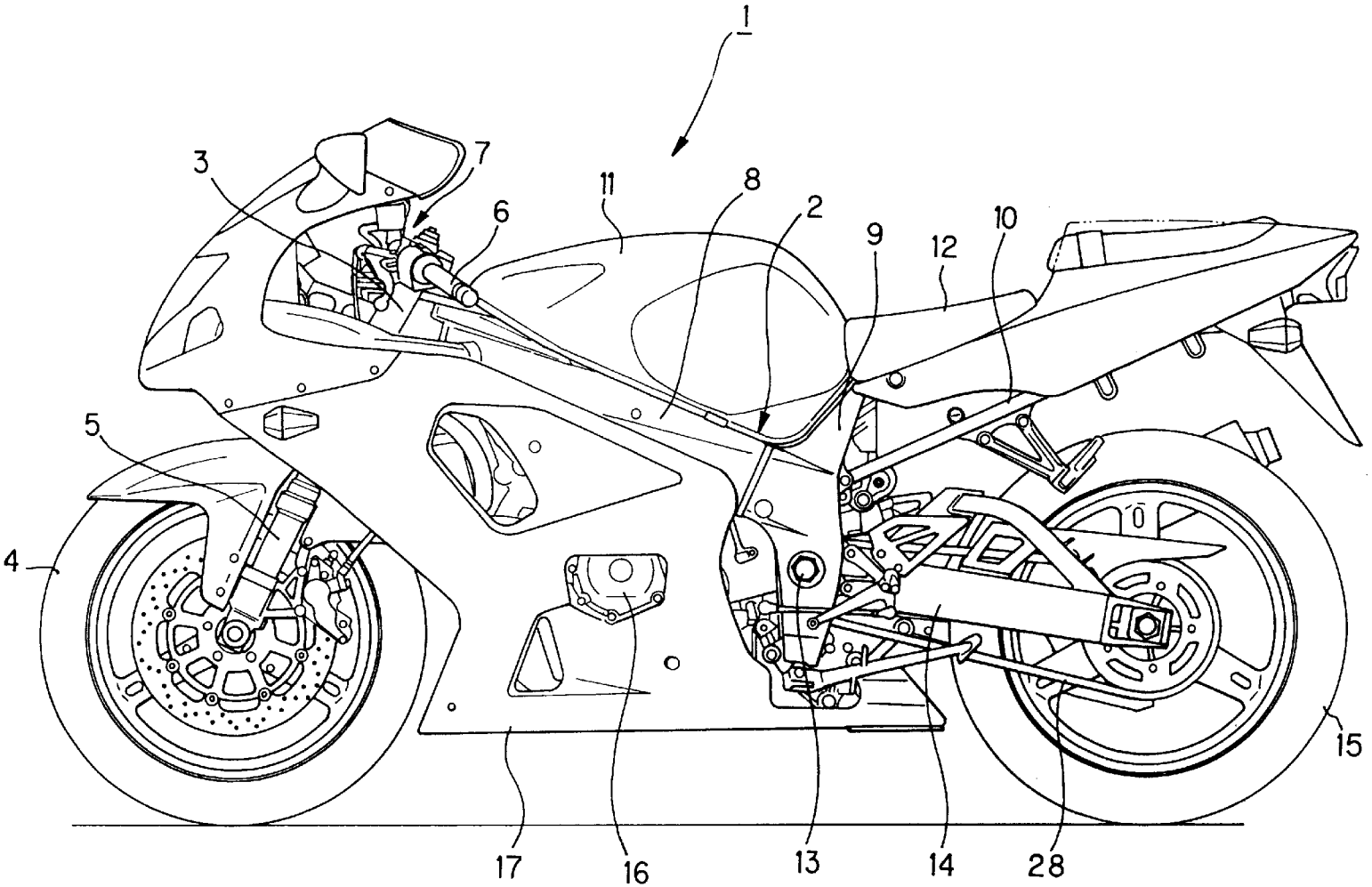
FIG. 1 is a general left side view showing a brief outer appearance of a motorcycle to which the present invention is applicable.

FIG. 1 is a general left side view showing a motorcycle to which the present invention is applicable. Referring to FIG. 1, the motorcycle 1 has a body frame 2, and a head pipe 3 is disposed in the front of the body frame 2.

A steering system 7 is mounted to the head pipe 3.

The steering system 7 comprises a pair of front forks 5 equipped with a suspension system inside (not shown), and a front wheel 4 supported rotatably by the front fork 5, and a handle bar 6. Further, the front wheel 4 is steered to right and left freely by the handle bar 6.

On the other hand, the body frame 2 is a twin-tube type frame, for example, that comprises a pair (right and left) of tank rails 8 which are widened right behind the head pipe 3 and extended down-rearward in parallel to each other, a pair of center frame 9 which are connected to the rear end of the tank rails 8 and extended downwardly, and a pair (right and left) of seat rails which extend backwards from the upper rear ends of the center frame 9.

A fuel tank 11 is provided above the tank rails 8 while a rider's seat 12 is provided above the seat rails 10.

A pivot shaft 13 is laid between the lower central parts of the center frames 9, and a front portion of a swing arm 14 is mounted swingabley to the pivot shaft 13 while a rear wheel 15 is supported rotatably at the end portion of the swing arm 14.

Further, an engine 16 is arranged below the fuel tank 11, and between the front wheel 4 and the rear wheel 15.

Furthermore, the front portion of the motorcycle 1 is covered by a cowling 17, which is designed for reducing the air resistance and protecting the rider from the wind pressure while the motorcycle 1 is traveling.

Figure 2:
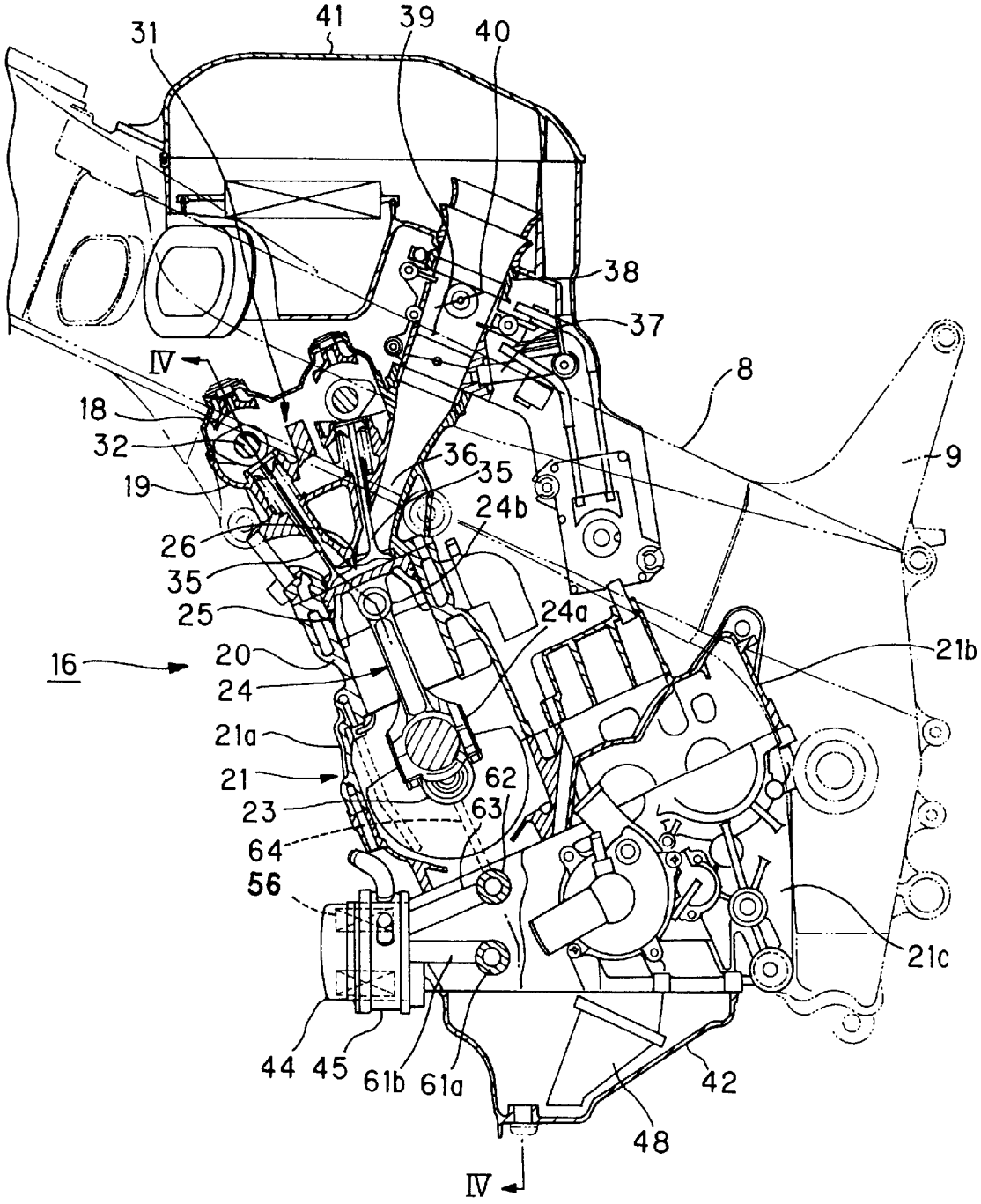
FIG. 2 is a left side sectional view showing a structure of the engine representing one embodiment relating to the present invention.
Figure 3:
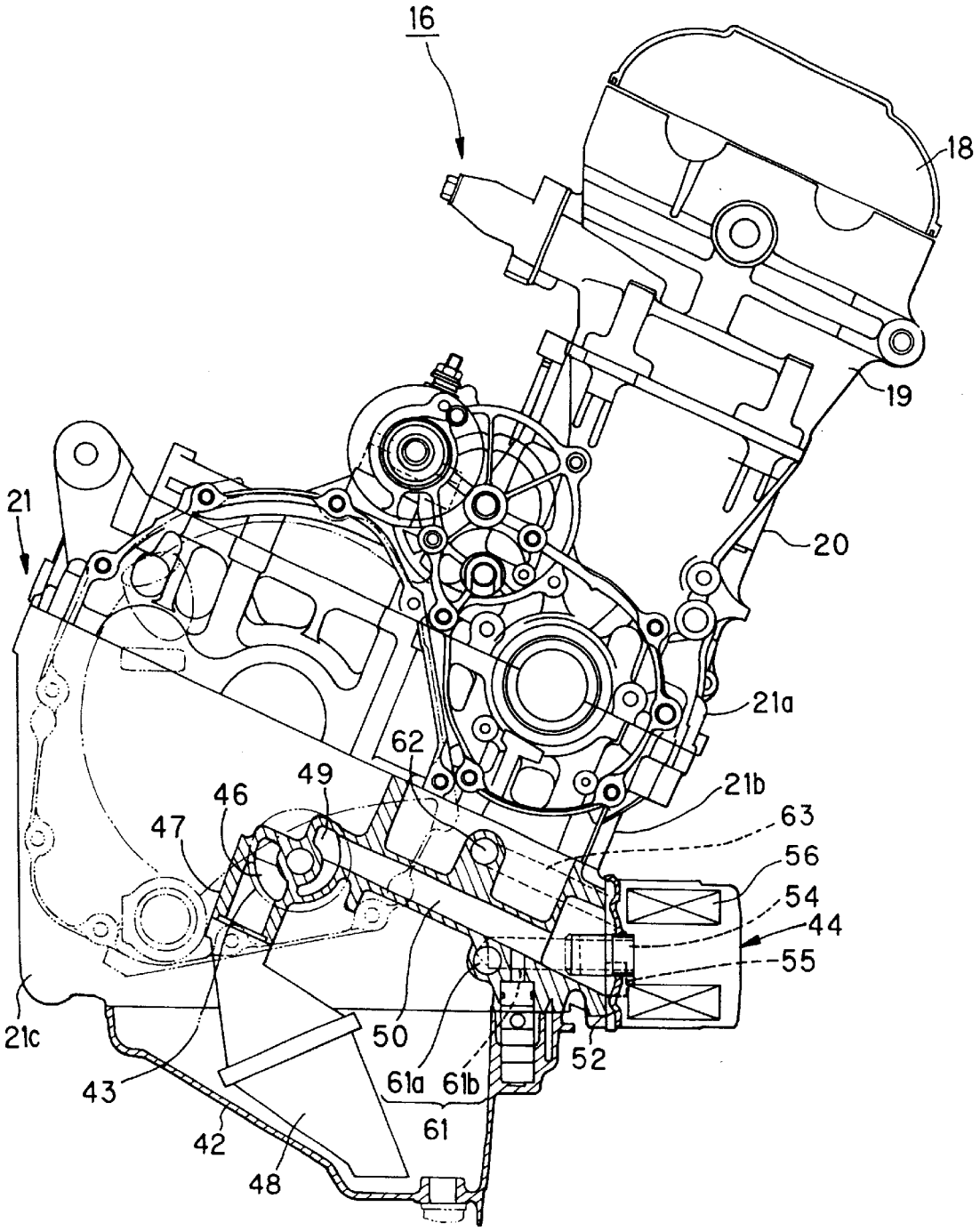
FIG. 3 is a right side view of an engine.

FIG. 2 is a left side view of the engine 16, and most of it is shown in a vertical section. Further, FIG. 3 is the right side view of engine 16, and a part of it is shown in a vertical section. Furthermore, FIG. 4 is a sectional view taken along the line IV—IV of FIG. 2.

Figure 4:
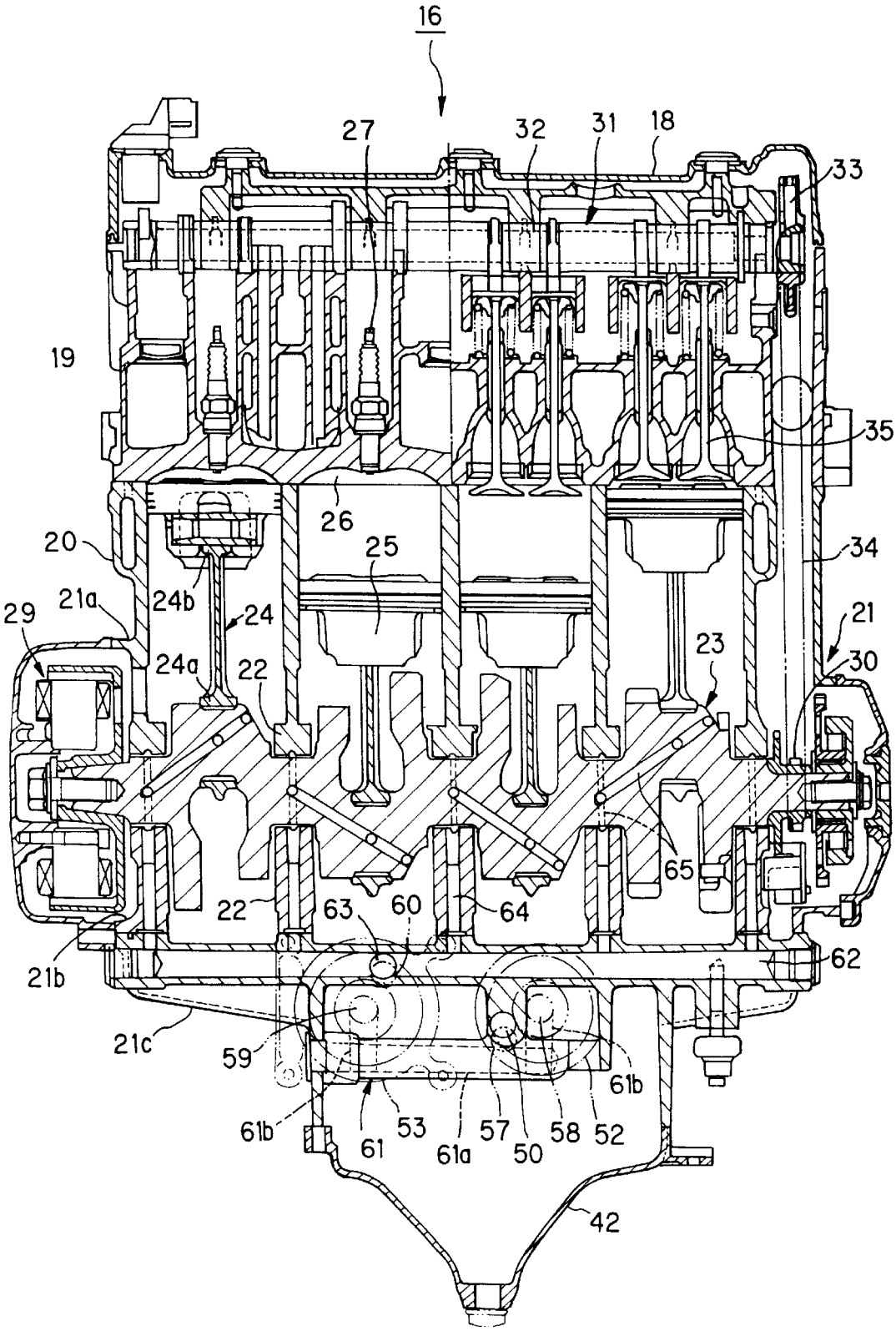
FIG. 4 is a sectional view taken along the line IV—IV of FIG. 2 showing a structure of the engine.

As shown in FIGS. 2 through 4, the engine 16 is a four-stroke-cycle engine with four cylinders lined in parallel, and is formed in its external form mainly by an engine case 21, a cylinder head cover 18, a cylinder head 19, and a cylinder block 20.

The engine case 21 is of a dividable type, and is divided into three pieces in vertical direction in a normal operating situation. The engine case 21 is composed by an upper engine case 21*a*, which has the cylinder block 20 formed uniformly, a center engine case 21*b*, and a lower engine case 21.

The cylinder block 20 is arranged in slightly forward leaned position rather than upright position, and matching surfaces of the engine cases 21*a*, 21*b*, 21*c* are formed normal to the central axes of cylinder block 20 so that the matching surfaces become obliquely upward to the rear (or obliquely downward to the front) of the engine 16 while the bottom surface portion of the lower engine case 21*c* is formed substantially horizontally.

Bearings 22 are formed inside the matching surfaces of the upper engine case 21*a* and the center engine case 21*b* separately, and a crankshaft 23 extending to the engine 16 width direction (i.e., normal to the direction of the vehicle movement) is supported rotatably by these bearings 22.

Large ends 24*a* of connecting rods 24 are connected to the crankshaft 23, while small ends 24*b* of the connecting rods are connected to pistons 25.

Further, the pistons 25 are disposed slidably in the cylinder block 20. The pistons 25 slide, in the figure, in vertical direction.

Furthermore, combustion chambers 26 are formed in the spaces between the bottom of the cylinder head 19 and the top of the pistons 25, and ignition plugs 27 are screwed onto the centers of the combustion rooms 26 from outer side of the cylinder head 19.

The reciprocation of the pistons 25 is transformed to a rotary motion by the crankshaft 23. This rotary motion is then transmitted to the rear wheel 15, which is the driven wheel, by a drive chain 28 (refer to FIG. 1) through a clutch system and a transmission system (both are not shown) disposed in a space formed inside the center engine case 21*b* and the lower engine case 21*c*.

An alternator 29 is disposed at one end of the crankshaft 23, while a cam-chain-drive-sprocket 30 is disposed at the other end of the crankshaft 23.

Camshafts 32 of a valve mechanism 31 are disposed in the cylinder head 19, and the cam-chain-drive-sprocket 30 is connected operatively to cam-sprockets 33 mounted at the end of the camshafts 32 by a cam-chain 34.

Further, the rotation of the crankshaft 23 is transmitted to the camshaft 32 by the cam-chain 34 that enables the valve mechanism 31 to open and close intake/exhaust valves 35 disposed in the cylinder head 19.

Furthermore, the cylinder head cover 18 covers the upper part of the cylinder head 19.

A fuel-injection system is employed in the motorcycle 1 for feeding fuel into the engine 16. A throttle body 38, which controls the airflow into the engine 16, is connected to each cylinder's intake port 36 formed in the cylinder head 19.

Each of the throttle body 38 is equipped with a throttle valve 40 in its intake passage. Further, the fuel injector 37, which injects the fuel directly into the intake passage in downstream side of the throttle valve 40, is disposed on the throttle body 38.

Furthermore, the throttle body 38 is disposed behind the upper part of the engine 16, while an air cleaner 41 is connected to the upstream side of the throttle body 38.

By the way, the engine 16 is equipped with a lubrication device. An oil pan 42 is attached to the bottom surface portion of the lower engine case 21*c* and the lubricating oil is stored therein. The lubricating oil in the oil pan 42 is pumped out by an oil pump 43 to the parts in the engine 16, such as the crankshaft 23, the valve mechanism 31 and transmission systems (not shown), for example, after going through an oil filter 44 and an oil cooler 45.

Figure 5:
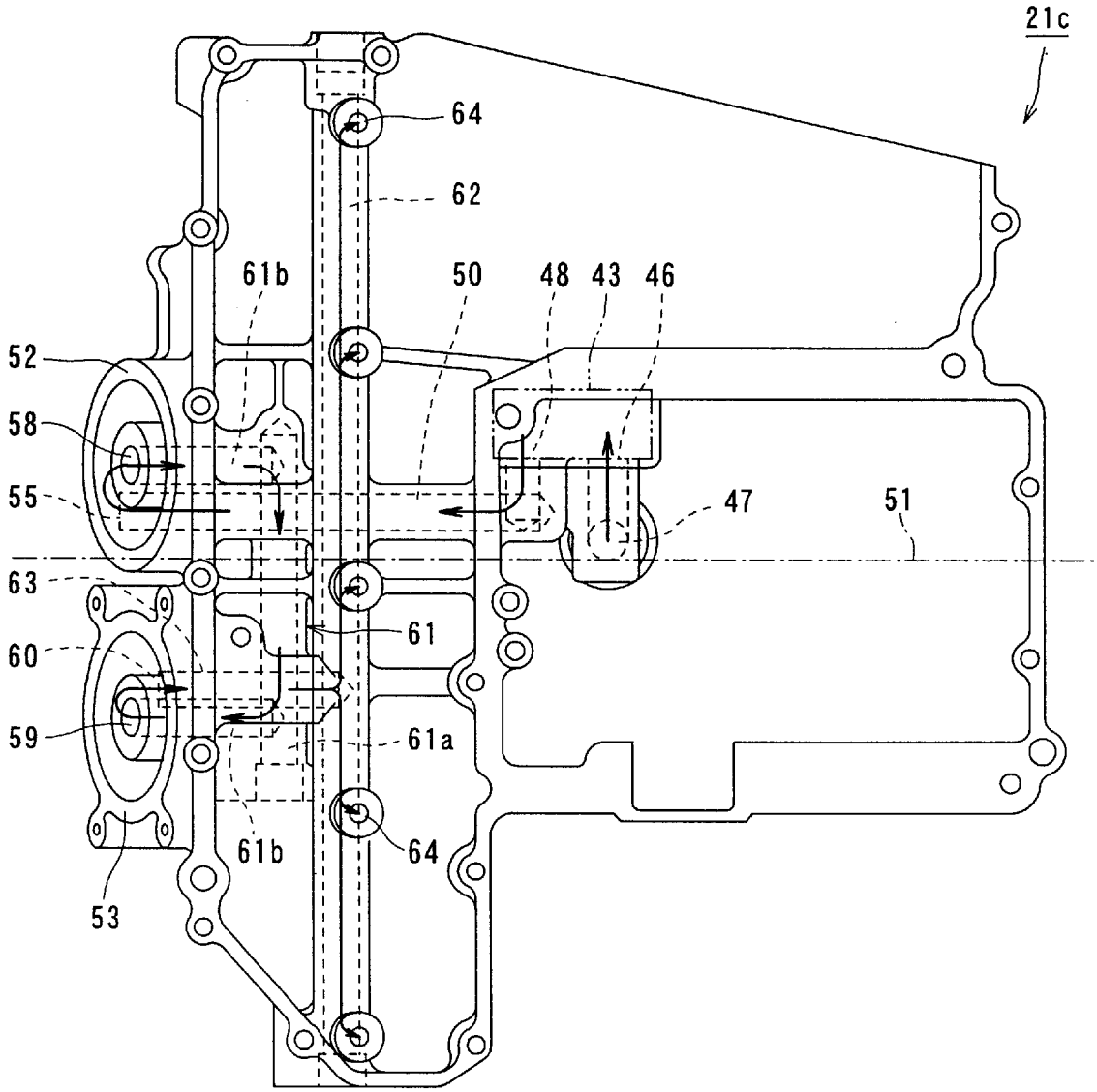
FIG. 5 is a plane view of a lower engine case.
Figure 6:
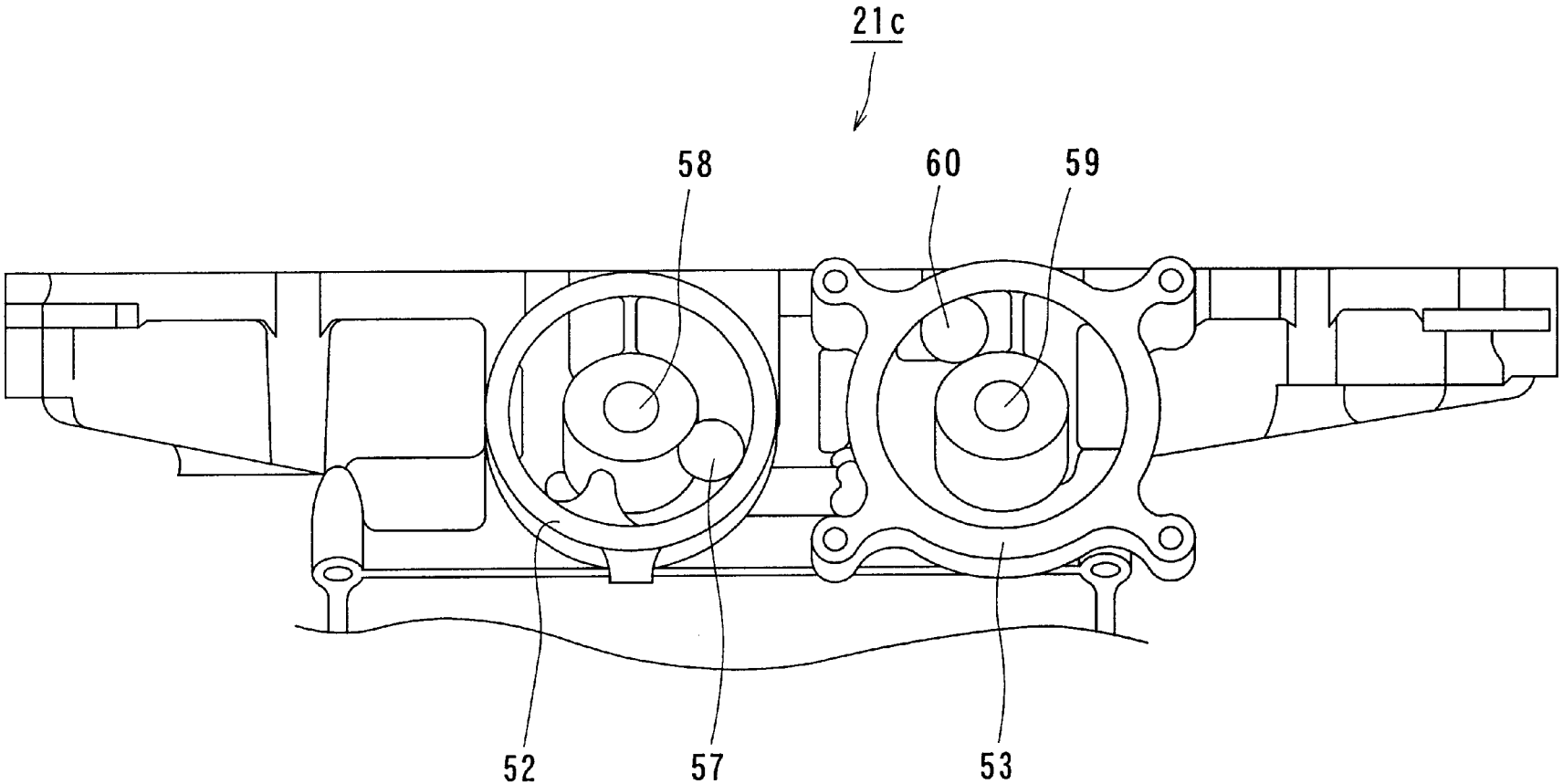
FIG. 6 is a front view of the lower engine case.

FIG. 5 is the plane figure of the lower engine case 21*c*, and FIG. 6 is a front figure of the lower engine case 21*c*.

As shown in FIGS. 3 and 5, the oil pump 43, which is driven by the crankshaft 23 for example, is disposed on the right side (facing the direction of the vehicle movement) of the lower engine case 21*c*.

As shown in FIGS. 2 through 6, an oil drawing passage 47 is extended into the oil pan 42 from an oil drawing port 46 of the oil pump 43.

A strainer 48, which removes comparatively large foreign objects in the lubricating oil, is disposed at the upstream end of the oil drawing passage 47.

On the other hand, an oil discharging passage 50, which is the first oil passage, is extended from an oil discharging port 49 of the oil pump 43 toward the front surface portion of the lower engine case 21*c*. The oil discharging passage 50 is arranged in parallel with the matching surfaces of the center engine case 21*b* and the lower engine case 21*c*, in other words, obliquely upward to the rear (or obliquely downward to the front) of the engine 16. Further, the oil discharging passage 50 is also arranged in parallel with the axis 51 of the vehicle's moving direction.

The front surface portion of the lower engine case 21*c* is formed normal to the matching surfaces of the lower engine case 21*c* and the oil pan 42, which is formed substantially horizontally. In other words, the front surface portion of the lower engine case 21*c* is formed substantially vertically.

Further, an oil-filter-mounting-base 52 and an oil-cooler-mounting-base 53 are formed onto the front surface portion of the lower engine case 21*c* side by side in the engine 16 width direction.

In this embodiment, the oil-filter-mounting-base 52 is arranged on the side that the oil pump 43 is arranged. In other words, this mounting-base 52 is arranged to the right side of the vehicle (facing the direction of the vehicle movement). On the other hand, the oil-cooler-mounting-base 53 is arranged on the opposite side of the other mounting-base 52, i.e., left side of the vehicle.

Furthermore, since FIG. 6 is the front view of the lower engine case 21*c*, the oil-filter-mounting-base 52 is show on the left while the oil-cooler-mounting-base 53 is shown on the right in FIG. 6.

The oil filter 44 is a generally known type, and this oil filter 44, which is attached to the oil-filter-mounting-base 52, has a circularly formed attaching face (not shown in detail in the figure). An oil exit 54 is formed in the center of the attaching face while an oil entrance 55 is formed around the oil exit 54. Further, a filter element 56 is disposed between the oil entrance 55 and the oil exit 54.

Furthermore, an oil entrance port 57 and an oil exit port 58 are formed in the oil-filter-mounting-base 52 coaxially. The oil exit port 58 is disposed in the center of the base 52 corresponding to the oil exit 54 of the oil filter 44, and the oil entrance port 57 is disposed in the circumference side of the oil exit port 58 corresponding to the oil entrance 55 of the oil filter 44, respectively. The downstream end of the above-mentioned oil discharging passage 50 extended from the oil discharging port 49 is connected to the oil entrance port 57.

On the other hand, the oil cooler 45, which is attached to the oil-cooler-mounting-base 53, has a circularly formed attaching face (not shown in detail in the figure). An oil entrance (not shown) is formed in the center of the attaching face while an oil exit (not shown) is formed around the oil entrance port. Further, the oil cooler 45 is a water-cooled type with a water jacket (not shown) is disposed between the oil entrance and the oil exit port.

Furthermore, an oil entrance port 59 and an oil exit port 60 are disposed in the oil-cooler-mounting-base 53 coaxially. The oil entrance port 59 is disposed in the center of the base 53 corresponding to the oil entrance of the oil cooler 45, and the oil exit port 60 is disposed in the circumference side of the oil entrance port 59 corresponding to the oil exit of the oil cooler 45, respectively.

Moreover, the oil entrance port 57 for the oil filter 44 and the oil exit port 60 for the oil cooler 45 are disposed separately in vertical direction. In this embodiment, referring to FIG. 6, the oil exit port 60 for the oil cooler 45 is located above the oil entrance port 57 for the oil filter 44.

The oil exit port 58 connected to the oil exit 54 of the oil filter 44 and the oil entrance port 59 connected to the oil entrance of the oil cooler 45 are connected by connecting passages 61.

The connecting passages 61 are composed of a main passage 61*a* and two sub-passages 61*b*, 61*b*. The main passage 61*a* is disposed behind the mounting-bases 52 and 53, below the oil discharging passage 50, and in parallel with the crankshaft 23. While the sub-passages 61*b*, 61*b*, which are the second oil passage, connect the oil exit port 58 for the oil filter 44 and the oil entrance port 59 for the oil cooler 45 to the main passage 61*a*.

These sub-passages 61*b*, 61*b* are disposed normal to the front surface portion of the lower engine case 21*c* where the oil-filter-mounting-base 52 and the oil-cooler-mounting-base 53 are formed. The sub-passages 61*b*, 61*b* are also disposed in parallel with the matching surfaces of the lower engine case 21*c* and the oil pan 42 which is formed substantially horizontally, i.e., the sub-passages 61*b*, 61*b* are disposed substantially horizontally.

A main gallery 62 is disposed above the oil discharging passage 50 and below the crankshaft 23, in parallel with the crankshaft 23 in the engine 16 width direction.

Further, an oil supplying passage 63, which is the third oil passage, is disposed from the oil exit port 60, which is connected to the oil exit of the oil cooler 45, toward the main gallery 62 in parallel with the matching surfaces of the center engine case 21*b* and the lower engine case 21*c*, i.e., obliquely upward to the rear (or obliquely downward to the front) of the engine 16. Furthermore, the oil supplying passage 63 is also arranged in parallel with the axis 51 of the vehicle's moving direction.

Further, the passages of the lubricating oil from the oil pump 43 to the main gallery 62 are formed with the oil discharging passage 50, the connecting passages 61 and the oil supplying passage 63.

Furthermore, oil supplying passages 64 are extended from the main gallery 62 toward the bearings 22 for the crankshaft 23 which are formed inside the matching surfaces of the upper engine case 21*a* and the center engine case 21*b*.

The lubricating oil stored in the oil pan 42 is pumped up by the oil pump 43 and fed into the oil filter 44 through the oil discharging passage 50.

The lubricating oil is guided into the oil filter 44 from the oil entrance 55 and filtered by the filter element 56. After the filtering, the lubricating oil is guided into the oil cooler 45 from the oil entrance through the connecting passages 61 (main passage 61*a* and sub-passages 61*b*, 61*b*) which are connected to the oil exit 54 of the oil filter 44.

The lubricating oil, cooled in the oil cooler 45, is then guided to the main gallery 62 from the oil exit of the oil cooler 45 through the oil supplying passage 63.

Furthermore, the lubricating oil reaches to the bearings 22 of the crankshaft 23 through the oil supplying passages 64, and lubricate the bearings 22.

The lubricating oil is then guided to the contacting surfaces of the crankshaft 23 and the large ends 24*a* of the connecting rods 24 through other oil supplying passages 65 which are formed inside the crankshaft 23.

Moreover, the lubricating oil is guided from the main gallery 62 to the every part of the engine 16 through other oil supplying passages (not shown).

Finally, the lubricating oil that lubricated the every part of the engine 16 would drop freely inside the engine case 21, and be circulated after being returned into the oil pan 42 through, for instance, oil returning holes and oil returning passages (not shown).

It becomes possible to arrange the passages without interfering to each other, and in a shortest distance within a narrow space by arranging the oil discharging passage 50 and the oil supplying passage 63 in parallel with the matching surfaces of the center engine case 21*b* and the lower engine case 21*c*, i.e., obliquely upward to the rear (or obliquely downward to the front) of the engine 16, and by disposing the sub-passages 61*b*, 61*b* of the connecting passages 61, which connect the oil exit 54 of the oil filter 44 and the oil entrance of the oil cooler 45, normal to the front surface portion of the lower engine case 21*c*, and in parallel with the matching surfaces of the lower engine case 21*c* and the oil pan 42, i.e., substantially horizontally.

As a result, the oil passages become simplified, and the reductions of the numbers of parts and processing time of the engine case 21 become possible.

Further, unnecessary crossings of the oil passages, in other words, the mutual interference of each passage may be prevented by disposing the oil entrance port 57 and the oil exit port 58 in the oil-filter-mounting-base 52 coaxially, and by disposing the oil entrance port 59 and the oil exit port 60 in the oil-cooler-mounting-base 53 coaxially, as well as disposing the oil exit port 58 for the oil filter 44 and the oil entrance port 59 for the oil cooler 45, which are connected to sub-passages 61*b*, 61*b* of the connecting passages 61 being arranged normal to the front surface portion of the lower engine case 21*c*, in the centers of the mounting-bases 52 and 53.

Moreover, unnecessary crossings of the oil passages, in other words, the mutual interference of each passage may be prevented by disposing the oil entrance port 57 for the oil filter 44 and the oil exit port 60 for the oil cooler 45, which are connected to the oil discharging passage 50 and the oil supplying passage 63, in the circumference side of the oil exit port 58 and the oil entrance port 59, and by disposing them separately in vertical position.

What is claimed is:

1. A lubrication device of four-stroke-cycle engine comprising an engine case dividable at least into two pieces in vertical direction in a normal operating situation, said divided engine case having matching surfaces being obliquely upward to the rear, a lower part of said engine case having substantially horizontal bottom surface portion, an oil pan attached to said bottom surface portion of said lower part of said engine case, oil passages, which guide lubricating oil in said oil pan to a main gallery by an all pump, formed in said lower part of said engine case, and an oil filter disposed on said oil passages, said lubrication device comprising:

a front surface portion of said lower part of said engine case being positioned normal to matching surfaces of said lower part of said engine case and said oil pan, an oil-filter-mounting-base positioned on said front surface portion of said lower part of said engine case, an oil passage, which extends within said lower part of said engine case to an oil entrance of said oil filter from said oil pump, formed in parallel with said matching surfaces of said divided engine case, and an additional oil passage positioned within said lower part of said engine case, which connects an oil exit of said oil filter and said main gallery.

2. A lubrication device of four-stroke-cycle engine according to claim 1, wherein said lubrication device further comprising:

an oil cooler disposed on said oil passages, and an oil-cooler-mounting-base formed with said oil-filter-mounting-base onto said front surface portion of said lower part of said engine case side by side in said engine width direction, wherein said oil passage is a first oil passage, and said additional oil passage comprises a second oil passage and a third oil passage, said second oil passage being connected to an oil exit of said oil filter and an oil entrance of said oil cooler and being positioned normal to said front surface portion of said lower part of said engine case, and in parallel with said matching surfaces of said lower part of said engine case and said oil pan, and said third oil passage being extended to said main gallery from an oil exit of said oil cooler and being formed in parallel with said matching surfaces of said divided engine case.

3. A lubrication device of four-stroke-cycle engine according to claim 2, wherein an oil entrance port and an oil exit port for said oil filter are disposed in said oil filter-mounting-base coaxially, and an oil entrance port and an oil exit port for said oil cooler are disposed in said oil-cooler-mounting-base coaxially, said oil exit port for said oil filter and said oil entrance port for said oil cooler being connected to said second oil passage which is formed normal to said front surface portion of said lower part of said engine case and being are disposed in center portions of said mounting-bases, said oil entrance port for said oil filter being connected to said first oil passage and being disposed on a circumference side of said oil exit port for said oil filter, and said oil exit port for said oil cooler being connected to said third oil passage and being disposed on the circumference side of said oil entrance port for said oil filter.

4. A lubrication device of four-stroke-cycle engine according to claim 2, wherein said oil entrance port for said oil filter and said oil exit port for said oil cooler are connected to said first and third oil passages and are disposed separately in a vertical direction.

5. A lubrication device of four-stroke-cycle engine according to claim 4, wherein said second oil passage is composed of two sub-passages which connect said oil exit port for said oil filter and said oil entrance port for said oil cooler to a main passage, while said main passage is disposed behind said mounting-bases and below said first oil passage.

6. A lubrication device of four-stroke-cycle engine according to claim 1, wherein said oil-filter-mounting-base and said oil pump are disposed on the same side of said engine.

* * * * *